United States Patent [19]

Jones

[11] Patent Number: 4,830,189

[45] Date of Patent: May 16, 1989

[54] CONTAINER

[76] Inventor: David L. Jones, 16 High Street South, Ruskington, Sleaford, Lincs, NG34 9DP, United Kingdom

[21] Appl. No.: 30,885

[22] Filed: Mar. 26, 1987

[51] Int. Cl.[4] ..... B65D 21/06

[52] U.S. Cl. ..... 206/506; 206/821; 229/918

[58] Field of Search ..... 206/505, 506, 507, 821, 206/509; 229/915, 918

[56] References Cited

U.S. PATENT DOCUMENTS

| | | | |
|---|---|---|---|
| 2,410,216 | 10/1946 | Insoll | 206/506 |
| 3,169,659 | 2/1965 | Blackmore | 206/506 |
| 3,421,656 | 1/1969 | Asenbauer . | |
| 3,547,309 | 12/1970 | Pusey | 206/507 |
| 3,586,205 | 6/1971 | VanDaalen | 206/506 |
| 3,651,977 | 3/1972 | Morgan . | |
| 3,878,980 | 4/1975 | Crane | 220/509 |
| 3,909,092 | 9/1975 | Kiernan . | |
| 3,913,741 | 10/1975 | Pirie | 206/509 |
| 3,944,073 | 3/1978 | Downing | 206/821 |
| 4,126,265 | 11/1978 | Holmes | 206/821 |

FOREIGN PATENT DOCUMENTS

| | | | |
|---|---|---|---|
| 921843 | 2/1973 | Canada | 206/506 |
| 2948282 | 8/1983 | Fed. Rep. of Germany . | |
| 2110178 | 6/1972 | France . | |
| 2296571 | 7/1976 | France . | |
| 2325565 | 4/1977 | France . | |
| 7905105 | 12/1980 | Netherlands | 206/506 |
| 1245100 | 2/1971 | United Kingdom | 206/506 |
| 1444356 | 7/1976 | United Kingdom . | |
| 2008077 | 5/1978 | United Kingdom . | |
| 1561225 | 2/1980 | United Kingdom . | |
| 1574117 | 9/1980 | United Kingdom | 206/506 |
| 2129401 | 5/1984 | United Kingdom . | |
| 2149757 | 6/1985 | United Kingdom . | |
| 2177377 | 1/1987 | United Kingdom | 206/506 |

*Primary Examiner*—George E. Lowrance

*Attorney, Agent, or Firm*—Poms, Smith, Lande & Rose

[57] ABSTRACT

A container comprises a body having a base and a side wall extending upwardly from the base. Support means is provided which is selectively movable between a first position in which a further container can be stacked inside the body, and a second position in which the support means can support a further container above the base.

13 Claims, 4 Drawing Sheets

CONTAINER

BACKGROUND OF THE INVENTION

This invention relates to a container.

SUMMARY OF THE INVENTION

According to the present invention there is provided a container comprising a body having a base and a side wall extending upwardly from the base, and support means selectively movable between a first position in which a further container can be stacked inside the body, and a second position in which the support means can support the further container above the base.

The container is especially suited for use as a receptacle for produce such as fruit and vegetables, including mushrooms. The movable support means enables the containers to be stacked within one another when they are empty, but to be stacked on top of one another, supported by the support means, when they contain produce.

Advantageously the support means includes detent means cooperating with the side wall in order to secure the support means in the support position.

Preferably the detent means comprises at least one formation adapted to engage a corresponding formation in the side wall. Preferably the detent means comprises two formations, and two corresponding side wall formations are provided. One side wall formation may be arranged on an outer surface of the side wall, and the other side wall formation may be arranged on an inner surface of the side wall.

Advantageously, the two formations of the detent means are adapted to clamp the sidewall therebetween when the support means is in the second position. This has been found to be particularly useful because it helps to prevent the support means inadvertently being moved out of the second position.

The side wall may have an upper rim having a portion extending outwardly of the container from the upwardly extending side wall, and a portion extending downwardly. The side wall formation in the outer face of the side wall is preferably formed in the downwardly extending portion.

Desirably at least one formation of the detent means is arranged to be a snap-fit with the corresponding side wall formation. This is achieved by arranging the support means so that the formation slides over the side wall before reaching the side wall formation and is deformed by the side wall during the sliding movement. When the formation reaches the recess it snaps into the recess. To this end it is preferred that the support means and the body are made of a resiliently deformable material. Alternatively, the sidewall could be deformed, or both the side wall and the formation could be deformed.

The or each side wall formation may conveniently comprise a recess provided in the side wall.

The container may be made of any suitable material, but polypropylene is preferred.

A hand grip recess may be provided in the side wall at two opposing sides of the container. The hand grip recesses serve the function of strengthening the side wall and providing a hand grip for lifting the container. The hand grip recesses may also provide a ledge; the ledge may be at the level of the upper rim to assist in supporting the further container. If the further container is misaligned with the support means, the ledge helps to prevent the further container from falling into the container and crushing the produce therein.

Advantageously, the support means is provided with a strengthening formation and the side wall is provided with a formation adapted to cooperate with the strengthening formation so that the strengthening formation can sit in the cooperating formation when the support means is in the second position. This arrangement enables the load applied to the support means to be directly transferred through the strengthening formation to the sidewalls and thus helps to prevent damage to the support means under stress.

In one embodiment the supportmeans is separate from the body, and is secured in the second position when desired.

However, in the preferred embodiment, the support means is mounted to the side wall, preferably to the upper rim of the side wall, by a hinge. This enables the support means to pivot between the first position and the second position.

In both embodiments the support means preferably comprises at least one support member. Preferably four support members are provided, each one being arranged adjacent an upper corner of the side wall. Each support member has a support surface upon which the further container can be supported.

The body and the support means may be injection moulded.

The further container is preferably a container according to the invention, although it may be any other suitable container.

BRIEF DESCRIPTION OF THE DRAWINGS

Reference is now made to the accompanying drawings in which.

DESCRIPTION OF THE PREFERRED EMBODIMENTS

Figure 1:
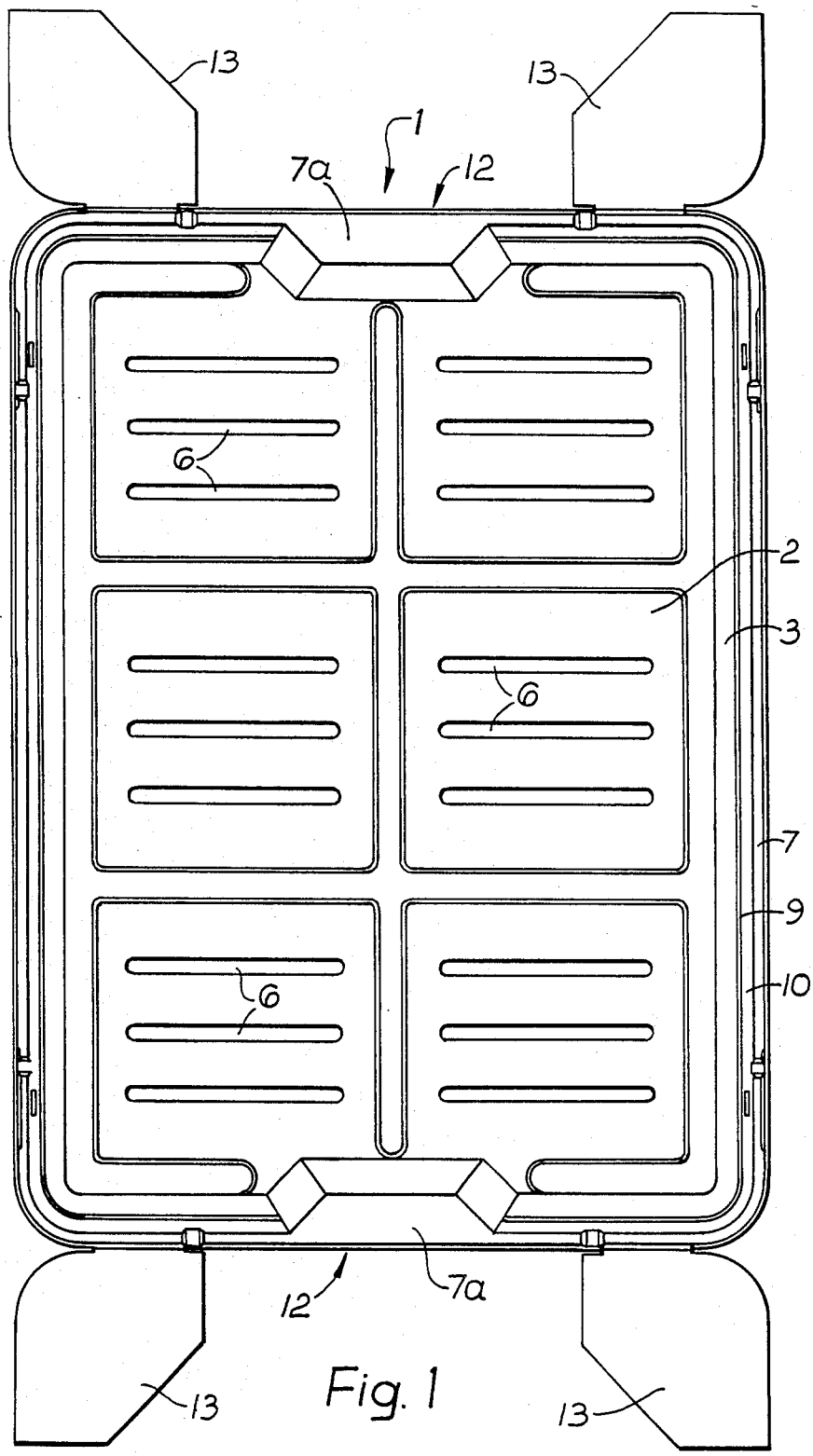
FIG. 1 is a plan view of a container according to the invention.
Figure 2:
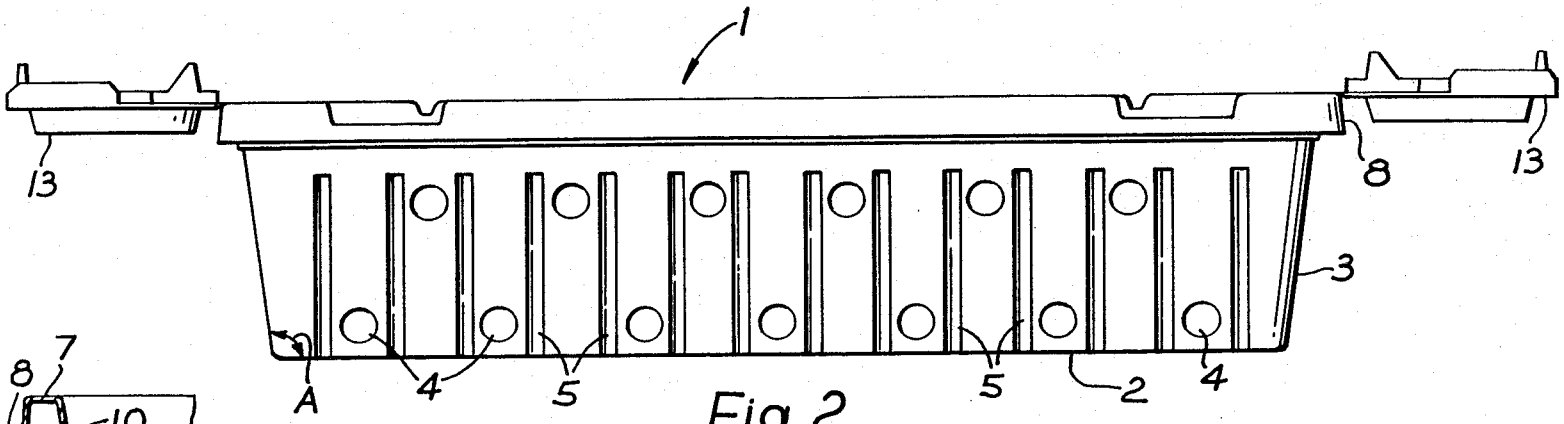
FIG. 2 is a side elevation of a container according to the invention.
Figure 3:
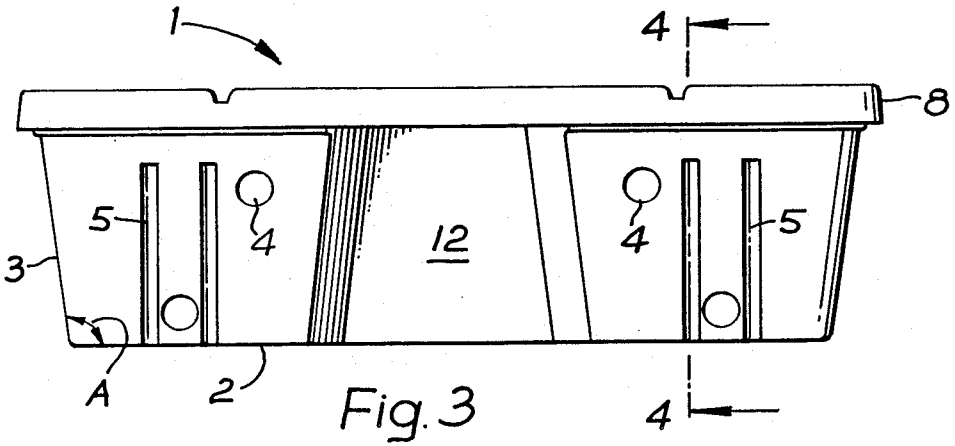
FIG. 3 is end view of a container according to the invention.

In FIGS. 1 to 3 a container generally designated 1 comprises a body having a base 2 and an upwardly extending side wall 3. The base 2 and the side wall 3 define a substantially hexahedral volume which can receive produce such as fruit and vegetables including mushrooms.

The side wall 3 is provided with a plurality of apertures 4 and strengthening formations in the form of ribs 5; in FIG. 1 the ribs 5 are not shown in order to increase the clarity. The base 2 is also provided with strengthening formations in the form of ribs 6.

A rim is provided around the top of the side wall 3 which comprises an outwardly extending portion 7 and a downwardly extending portion 8.

Figure 4:
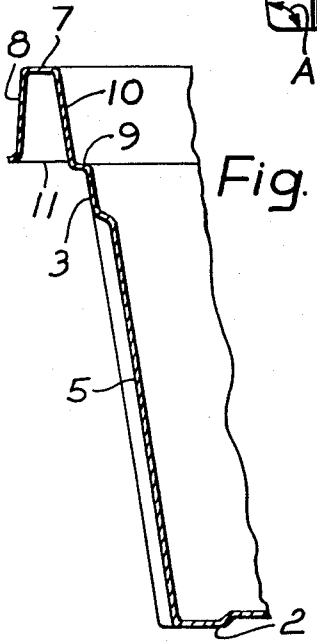
FIG. 4 is a section on lines 4—4 of FIG. 3.

The side wall 3 is provided with a ledge 9 at a level below the bottom of the downwardly extending portion 8 (see FIG. 4). The side wall 3 has a portion 10 extending between the ledge 9 and the outwardly extending portion 7. The portions 7, 8 and 10 are arranged so that they have a substantially U-shaped cross-section. A plurality of ribs 11 extend between the downwardly extending portion 8 and the portion 10 for the purpose of strengthening the rim.

A hand grip recess 12 is provided at opposing sides of the container 1. As shown in FIG. 1, in the region of the hand grip recess 12 the width of the outwardly extending portion 7 is greater than around the rest of the rim to provide a ledge 7*a*. This facilitates gripping the container 1 underneath the rim so that it can be lifted.

The hand grip recess 12 also provides additional strengthening for the container 1, and assists with the support of further containers on top of the container 1.

The container 1 is also provided with support means in the form of support members 13. Four of said support members 13 are provided, each one being disposed adjacent an upper corner of the side wall 3. In FIGS. 1 and 2, the support members 13 are not shown in detail, and in FIG. 3 the support members have been omitted for the purpose of clarity.

Figure 5:
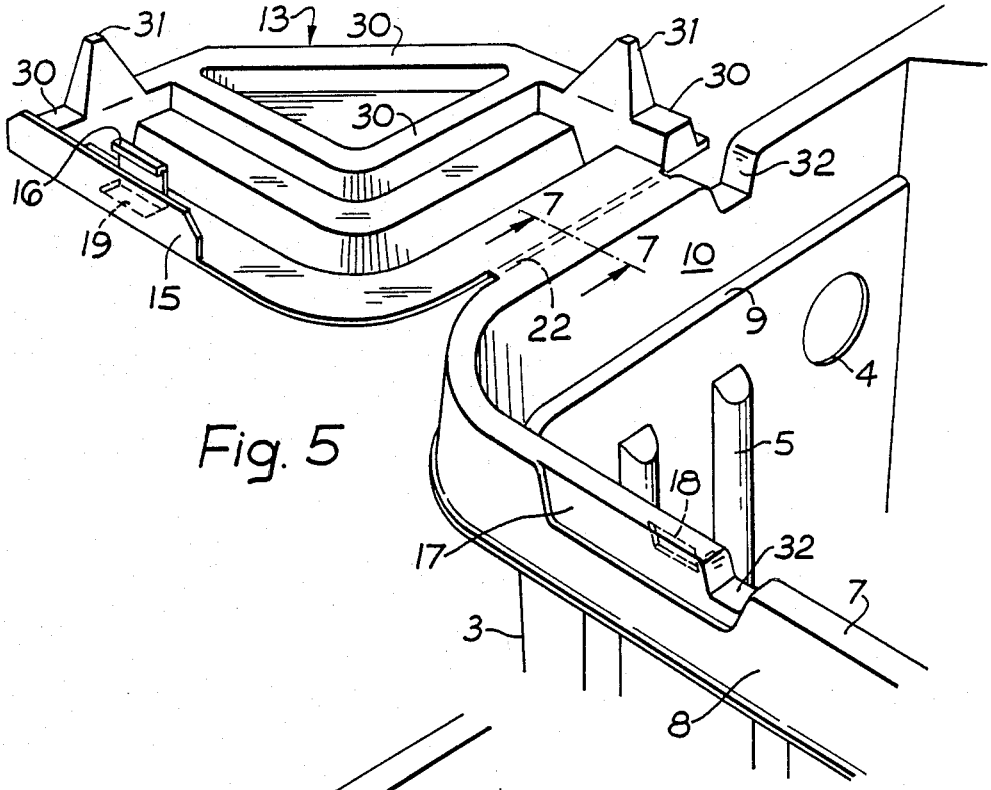
FIG. 5 is a perspective view on an enlarged scale of part of a container according to the invention showing support means in the first position.
Figure 6:
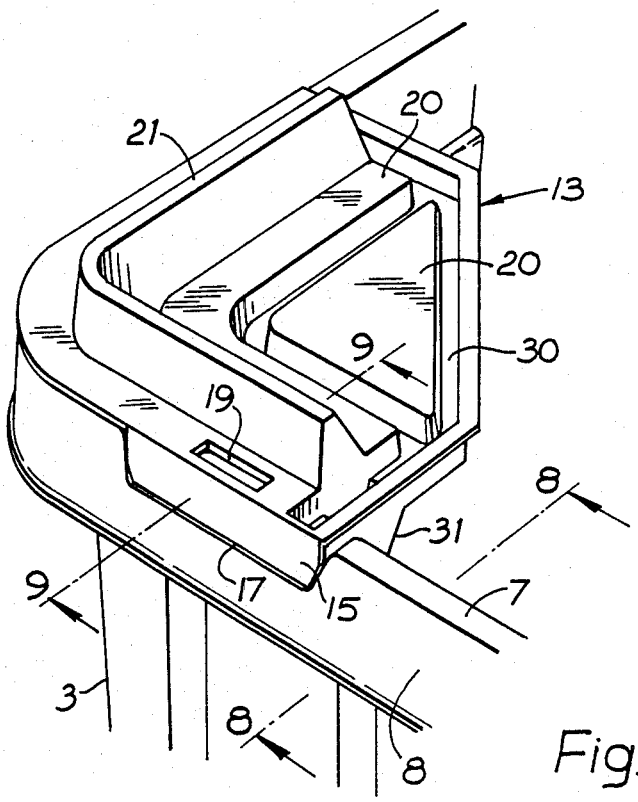
FIG. 6 is a perspective view on an enlarged scale of part of a container according to the invention showing support means in the second position.

FIGS. 5 and 6 show the construction of the support members 13 in more detail.

One face of each support member 13 includes detent means in the form of formations 15 and 16. The formation 15 can fit into a corresponding recess 17 provided in the downwardly extending portion 8 of the side wall 3. Formation 16 can fit into a corresponding recess 18 provided in the portion 10 of the side wall 3. Four of each of said recesses 17 and 18 are provided, one pair of recesses for each support member 13.

Figure 9:
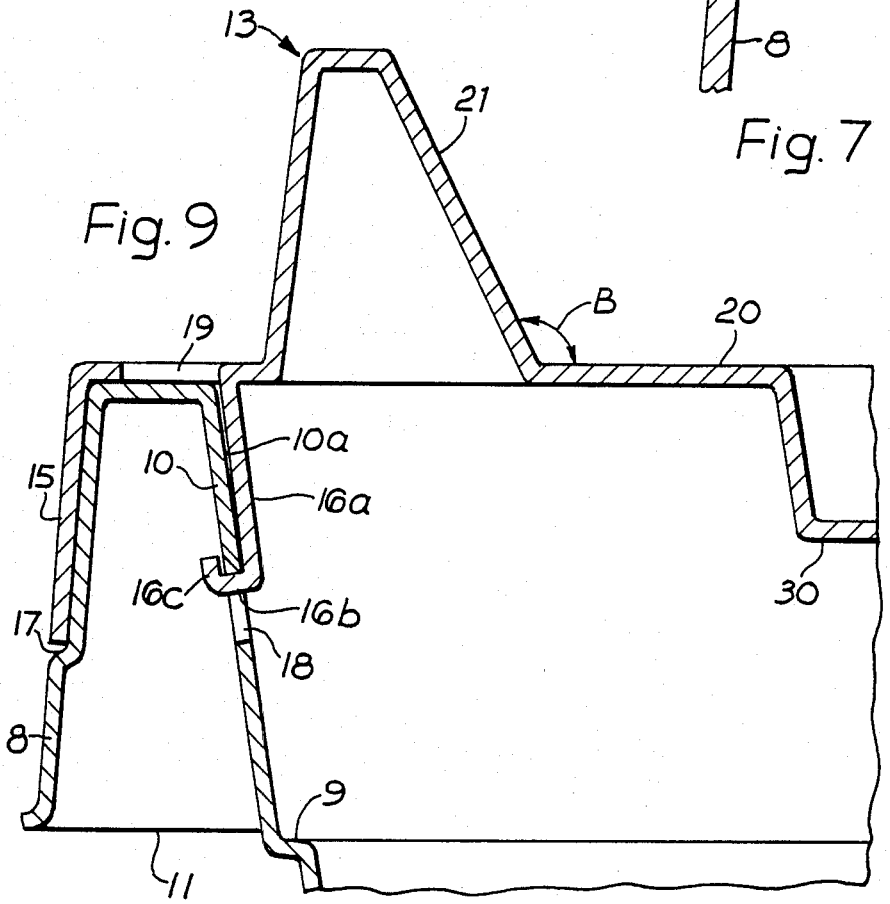
FIG. 9 is a section on lines 9—9 of FIG. 6 on an enlarged scale.

The formation 16 includes a first portion 16*a*, a second portion 16*b* and a third portion 16*c*, as shown in FIG. 9. When one of the support members 13 is moved into engagement with the side wall 3, the third portion 16*c* abuts against a surface 10*a* of the portion 10 and slides over the surface 10*a*. During the sliding movement the first portion 16*a* is deformed inwardly of the container 1. When the portion 16*c* reaches the recess 18, the portion 16*a* springs back as far as possible to its original position thus locking the formation 16 to the recess 18. In this way a snap-fit is provided between the formation 16 and the recess 18. To this end it is preferable to make the container 1 from a resiliently deformable material such as polypropylene.

Thus, the formations 15 and 16 serve to clamp the sidewall therebetween, thereby locking the support members 13 securely to the sidewall 3.

An aperture 19 is provided in the support members 13 between the formation 15 and the formation 16.

Figure 8:
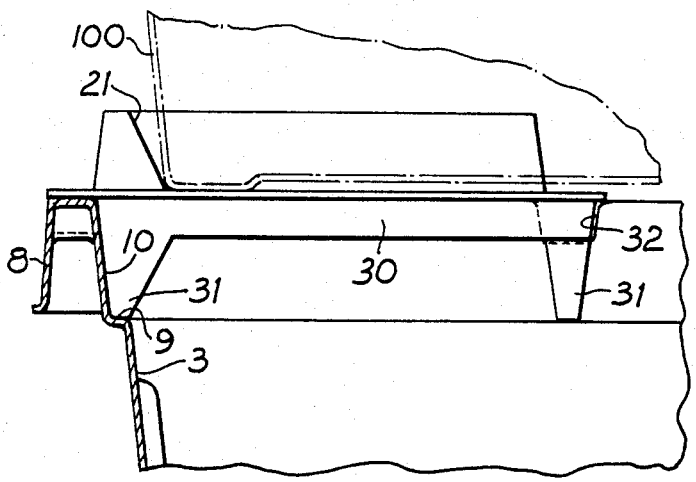
FIG. 8 is a section on lines 8—8 of FIG. 6 on an enlarged scale.

The other face of the support members 13 provides a support surface 20 for supporting a further container 100 (see FIG. 8). The support surface 20 is bounded by a shaped projection 21 which in FIG. 9 is shown extending upwardly from the support surface 20 at an obtuse angle B thereto. This arrangement enables the further container 100 to be received on the support surface 20 and in engagement with the projection 21. When the further container is identical to the container 1, the obtuse angle B can be the same as or greater than angle A (see FIGS. 2 and 3) of the side wall 3 to the base 2. The projection 21 is of considerable help with the correct alignment of the further container 100 on the container 1; furthermore, the projection 21 acts as a retaining means to retain the further container 100 in position.

Figure 7:
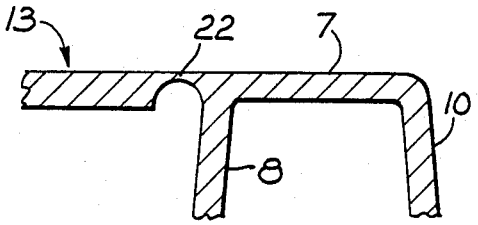
FIG. 7 is a section on lines 7—7 of FIG. 5 on an enlarged scale.

The support members 13 are pivotally connected to the outwardly extending portion 7 of the side wall 3 by a hinge 22 (as shown in FIG. 7). The hinge 22 enables the support member 13 to pivot about the hinge.

The support members 13 are movable between a first position in which they lie outside the body of the container 1 (as shown in FIGS. 1, 2 and 5) and a support position in which the formations 15 and 16 engage the recesses 17 and 18 (as shown in FIGS. 6, 8 and 9).

In the first position the containers 1 can be stacked one inside the other, so that a large number of containers can be stored in a small space.

When the containers 1 are filled with produce, for example with mushrooms, then the support members 13 can be pivoted to the second position. This enables the further container 100 to be stacked on the container 1 without crushing the produce contained therein.

The support members 13 include a strengthening formation 30 having two projections 31 extending therefrom. The formation 30 is shaped to be able to sit in two cooperating formations 32 provided in the rim of the side wall 3. When the support members 13 are in the second position, the strengthening formation 30 sits in the cooperating formations 32, and the projections 31 bear against the portion 10. This arrangement transfers the load of the further container 100 onto the side wall 3 and helps to reduce damage to the support members 13 through stress.

In another embodiment (not shown) the support members 13 can be separate from the side wall 3, and are secured to the side wall in the second position when required. In this embodiment the hinge 22 is replaced by an extra pair of said formations 15 and 16 which can engage an extra pair of said corresponding recesses 17 and 18. These extra formations and recesses ensure that the support members 13 are firmly secured to the body of the container in the second position.

I claim:

1. A container comprising:

a preformed body having a base and a side wall extending upwardly from the base, said side wall including at least one load receiving side wall portion and at least one detent receiving means;

support means integral with said container and pivotally engaged to said container for selectively allowing a further container to be stacked inside said body when in a first position, and for selectively supporting said further container above said base when in a second position, said support means including load transferring projection means extending downward from said support means when in said second position for engaging said load receiving side wall portions and for helping to prevent lateral movement of said support means with respect to said body due to said engagement of said load transferring projection means with said load receiving side wall portions when said support means is in said second position so that said engagement of said load transferring projection means with said load receiving side wall portions provides additional support for said support means when supporting said further container; and detent means integral with said support means for removably securing said support means in said second position, said detent receiving means of said side wall for removably receiving said detent means, said detent means including at least one detent portion, each of said detent portions capable of removably engaging a corresponding one of said detent receiving means .

2. A container according to claim 1 wherein said detent means comprises two formations adapted to clamp said side wall therebetween when said support means is in said second position.

3. A container according to claim 2, wherein said side wall has an upper rim having a portion extending outwardly of said container and a portion extending downwardly of said container.

4. A container according to claim 3 wherein said support means is adapted so that at least one of said formations of said detent means is capable of sliding over said side wall before removably engaging said side wall and each of said sliding formations of said detent means is deformed by said side wall during said sliding movement in order that each of said sliding formations is capable of snap-fitting to said side wall.

5. A container according to claim 4 wherein said side wall has a hand grip recess at each of two opposing sides of said container, said hand grip recesses serving to strengthen said side wall and to provide a hand grip for lifting said container, and said hand grip recesses each provide a ledge which assists in supporting said further container above said base

6. A container according to claim 5 wherein said support means is mounted to said side wall so that said support means is pivotable between said second position to said first position outside said body of said container.

7. A container according to claim 1 wherein said load transferring projection means of said support means includes a projection extending continuously along an outer edge of said support means, and said side wall has at least two load receiving side wall portions, said continuously extending projection engaging said load receiving side wall portions when said support means is in said second position, said load receiving side wall portions having cooperating formations adapted to cooperate with said continuously extending projection in order that said continuously extending projection can sit in and engage said cooperating formations when said support is in said second position so that any load applied to said support means is transferred to said side wall and said engagement of said continuously extending projection with said cooperating formations provides additional support for said support means when supporting said further container.

8. A container comprising a preformed body having a base and a side wall extending upwardly from said base;

support means integral with said container for selectively allowing a further container to be stacked inside said body when in a first position, and for selectively supporting said further container above said base when in a second position, said support means including (a) projections extending upward therefrom in order to receive and position said further container when said support means is in said second position, each of said upwardly extending projections including a surface extending upward at an obtuse angle to guide said further container into a proper position when said further container is stacked on said support means, and (b) projections extending downward from said support means, said downwardly extending projections engaging said side wall when said support means is in said second position in order to provide additional support for said support means when supporting said further container; and detent means integral with said support means for cooperating with said side wall in order to secure said support means in said second position, said detent means comprising two formations adapted to engage corresponding formations of said side wall, said detent means formations being adapted to clamp said side wall therebetween when said support means in in said second position, one of said detent means formations including a detent portion capable of removably engaging an aperture in one of said corresponding formations in said side wall.

9. A container according to claim 8 wherein said detent means has two of said detent means formations and said side wall has two corresponding side wall formations, one surface of said side wall, and the other side wall formation being arranged on an inner surface of said side wall.

10. A container according to claim 9 wherein said side wall has an upper rim having a portion extending outwardly of said container and a portion extending downwardly of said container.

11. A container according to claim 10 wherein said support means is adapted so that at least one of said formations of said detent means is capable of sliding over said side wall before removably engaging said side wall and each of said sliding formations of said detent means is deformed by said side wall during said sliding movement in order that each of said sliding formations is capable of snap-fitting to said side wall.

12. A container comprising:

a preformed body having a base and a side wall extending upwardly from said base, said side wall including two corresponding side wall formations with one side wall formation being arranged on an outer surface of said side wall, and the other side wall formation being arranged on an inner surface of said side wall;

support means integral with said container and pivotally engaged to said container for selectively allowing a further container to be stacked inside the body when in a first position and for selectively supporting the further container above the base when in a second position, said support means including (a) formations extending upward therefrom in order to receive and position said further container when said support means is in said second position, each of said support means formations including a surface extending upwardly at an obtuse angle to guide said further container into a proper position when said further container is stacked on said support means, and (b) at least one projection extending downward from said support means and engaging at least one corepsonding cooperating formation in said inner surface side wall formation when said support means is in said second position, said engagement of said downwardly extending projections with said side wall cooperating formations provides additional support for this support means when supporting said further container; and detent means integral with said support means for removably securing said support means in said second position, said detent means including a least one formation with a detent portion, each of said detent portions capable of removably engaging a recess in one of said side wall foramtions.

13. A container according to claim 12 wherein said container has a support means at each corner thereof.

* * * * *